US010476131B2

(12) United States Patent
Chang et al.

(10) Patent No.: US 10,476,131 B2
(45) Date of Patent: Nov. 12, 2019

(54) ELECTRONIC DEVICE HAVING ANTENNA

(71) Applicant: HONGBO WIRELESS COMMUNICATION TECHNOLOGY CO., LTD., Taipei (TW)

(72) Inventors: Yao-Yuan Chang, Taipei (TW); Chih-Chia Huang, Taipei (TW); Tsung-Wen Chiu, Taipei (TW)

( * ) Notice: Subject to any disclaimer, the term of this patent is extended or adjusted under 35 U.S.C. 154(b) by 454 days.

(21) Appl. No.: 15/334,073

(22) Filed: Oct. 25, 2016

(65) Prior Publication Data

US 2018/0026331 A1 Jan. 25, 2018

(30) Foreign Application Priority Data

Jul. 22, 2016 (TW) ..... 105123412 A

(51) Int. Cl.

| | |
|---|---|
| ***H01Q 1/22*** | (2006.01) |
| ***H01Q 13/10*** | (2006.01) |
| ***H01Q 1/50*** | (2006.01) |
| ***H01Q 9/06*** | (2006.01) |
| ***H01Q 1/48*** | (2006.01) |

(52) U.S. Cl.

CPC ..... *H01Q 1/2266* (2013.01); *H01Q 1/22* (2013.01); *H01Q 1/48* (2013.01); *H01Q 1/50* (2013.01); *H01Q 9/065* (2013.01); *H01Q 13/10* (2013.01); *H01Q 13/106* (2013.01)

(58) Field of Classification Search

CPC ..... H01Q 1/50; H01Q 1/2266; H01Q 13/106; H01Q 1/48; H01Q 9/065; H01Q 1/22; H01Q 13/10

USPC ..... 343/702

See application file for complete search history.

(56) References Cited

U.S. PATENT DOCUMENTS

| | | | | |
|---|---|---|---|---|
| 7,068,229 | B2 | 6/2006 | Lin | |
| 8,264,412 | B2 * | 9/2012 | Ayala | H01Q 9/42 343/700 MS |
| 9,036,339 | B2 | 5/2015 | Schlesener et al. | |
| 9,203,137 | B1 * | 12/2015 | Guterman | H01Q 1/2266 |
| 2001/0040529 | A1 | 11/2001 | Cheng et al. | |
| 2008/0238787 | A1 * | 10/2008 | Lin | G06F 1/1616 343/702 |
| 2010/0073243 | A1 | 3/2010 | Ayala Vazquez et al. | |
| 2010/0149751 | A1 * | 6/2010 | Camacho | G06F 1/1616 361/679.55 |
| 2010/0321255 | A1 * | 12/2010 | Kough | H01Q 1/2266 343/702 |

(Continued)

*Primary Examiner* — Hai V Tran

(74) *Attorney, Agent, or Firm* — Opes IP Consulting Co., Ltd.

(57) ABSTRACT

An electronic device having an antenna comprises a first metal casing, a second metal casing, a first hinge, a second hinge, and a first dipole antenna. A first slot antenna structure having a first half-wavelength resonant mode is constituted by the first hinge, the first metal casing, the second hinge and the second metal casing. The width of a first middle portion of the first slot antenna structure is narrower than the widths of the two end portion. The first dipole antenna unit located in the middle portion of the first slot antenna structure has a second half-wavelength resonant mode. The first dipole antenna is for exciting the first half-wavelength resonant mode. Accordingly, the antenna can be integrated with the hinges of the electronic device.

9 Claims, 5 Drawing Sheets

(56) References Cited

U.S. PATENT DOCUMENTS

2012/0068893 A1* 3/2012 Guterman ..... H01Q 1/2266
343/702
2013/0257660 A1 10/2013 Wong et al.

* cited by examiner

ELECTRONIC DEVICE HAVING ANTENNA

CROSS-REFERENCE TO RELATED APPLICATIONS

This non-provisional application claims priority under 35 U.S.C. § 119(a) on Patent Application No(s). 105123412 filed in Taiwan (R.O.C) on Jul. 22, 2016, the entire contents of which are hereby incorporated by reference.

BACKGROUND

Technical Field

The disclosure relates to an electronic device, and more particularly to an electronic device having an antenna at its hinge.

Related Art

One important feature of the electronic device having ability of wireless communication or wireless network is portability. For example, laptop is a computer device easy for carrying. Please refer to FIG. 1; the appearance of the laptop mainly includes three portions such as the top cover 1 having a screen, the hinge 2, and the bottom cover 3. Owing to the development of the wireless networking technology, the conventional laptop necessarily has the wireless networking functionality. The hidden antenna is used in the conventional laptop so as to keep brief appearance. However, the application of multi-band communication of the hidden antenna, such as the capability of being operated with IEEE 802.11 b/g spec which is at the band of 2.4 GHz and with IEEE 802.11 a/n/ac wireless local area network (WLAN) spec which is at the band of 5 GHz, still needs to be considered. Further, certain new laptop is requested to support the wireless wide area network (WWAN) application such as the wireless networking ability for long term evolution (LTE) so that the bands and the bandwidth of wireless communication utilized by the laptop is increasing.

For the stability in use, the hidden antenna of the laptop is usually located in the top cover 1. However, the frame of screen of the laptop is usually narrowed by the manufacturer for the sake of the design of the appearance, so the space for disposing the antenna is reduced tremendously. It is a severe challenge for the designer of the antenna of the laptop for keeping the quality of wireless communication or increasing the efficiency of wireless transmission.

SUMMARY

In one embodiment of the disclosure, an electronic device having an antenna includes a first metal casing, a second metal casing, a first hinge, a second hinge, and a first dipole antenna. The first metal casing has a first side edge. The second metal casing has a second side edge. The first hinge is conductively connected to the first side edge of the first metal casing and the second side edge of the second metal casing, respectively. The second hinge is conductively connected to the first side edge of the first metal casing and the second side edge of the second metal casing, respectively. A first slot antenna structure is composed of the first metal casing, the second metal casing, the first hinge and the second hinge. The first slot antenna structure has a first half-wavelength resonant mode. The first slot antenna structure has a first middle portion and two first end portions. The width of the first middle portion is less than the width of each of the two first end portions. The first dipole antenna is disposed in the first middle portion of the first slot antenna structure. The first dipole antenna has a second half-wavelength resonant mode. The first dipole antenna has a first radiation portion and a second radiation portion. The first radiation portion has a first feeding terminal. The second radiation portion has a first ground terminal. The first dipole antenna is used for exciting the first half-wavelength resonant mode of the first slot antenna structure. Wherein both of the first metal casing and the second metal casing are electrically connected to the first ground terminal.

BRIEF DESCRIPTION OF THE DRAWINGS

The present disclosure will become more fully understood from the detailed description given hereinbelow and the accompanying drawings which are given by way of illustration only and thus are not limitative of the present disclosure and wherein.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
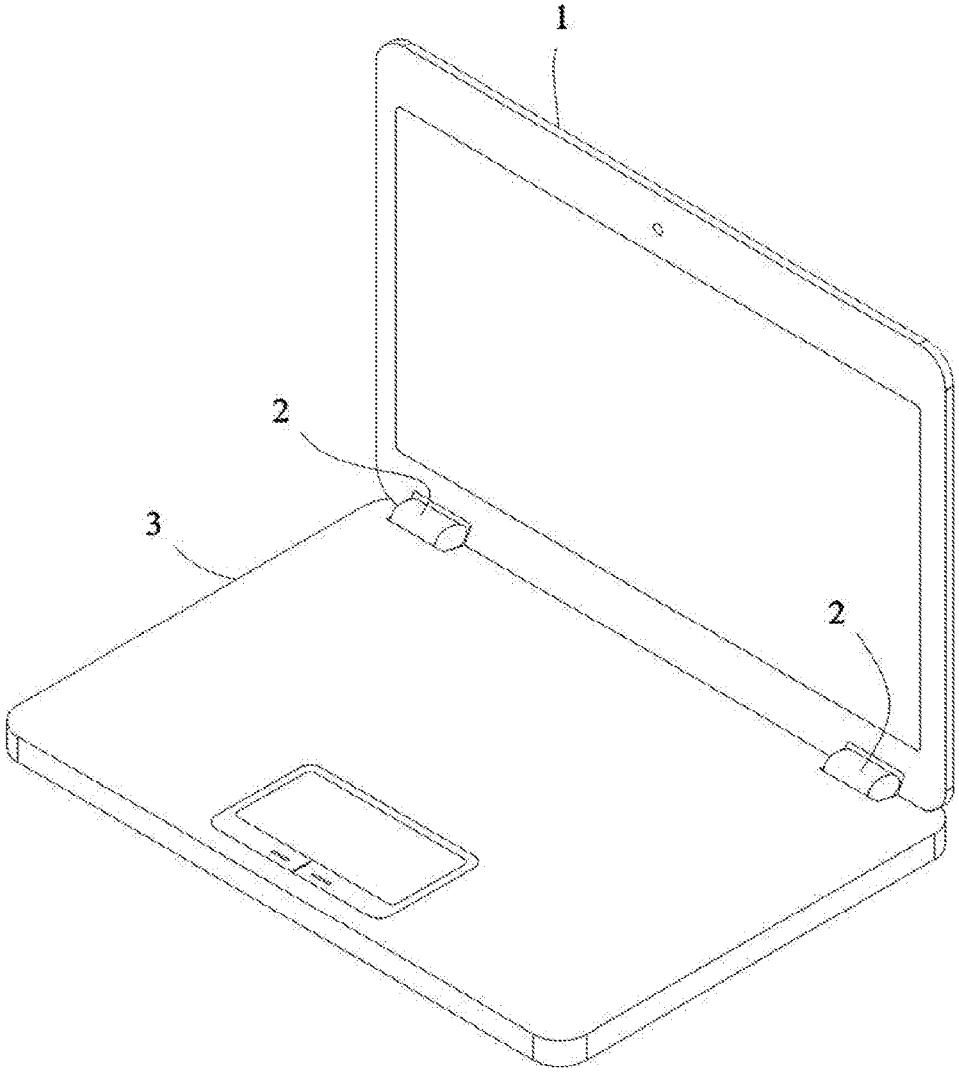
FIG.1 (PRIOR ART)
FIG. 1 is a schematic of a conventional laptop.
Figure 2:
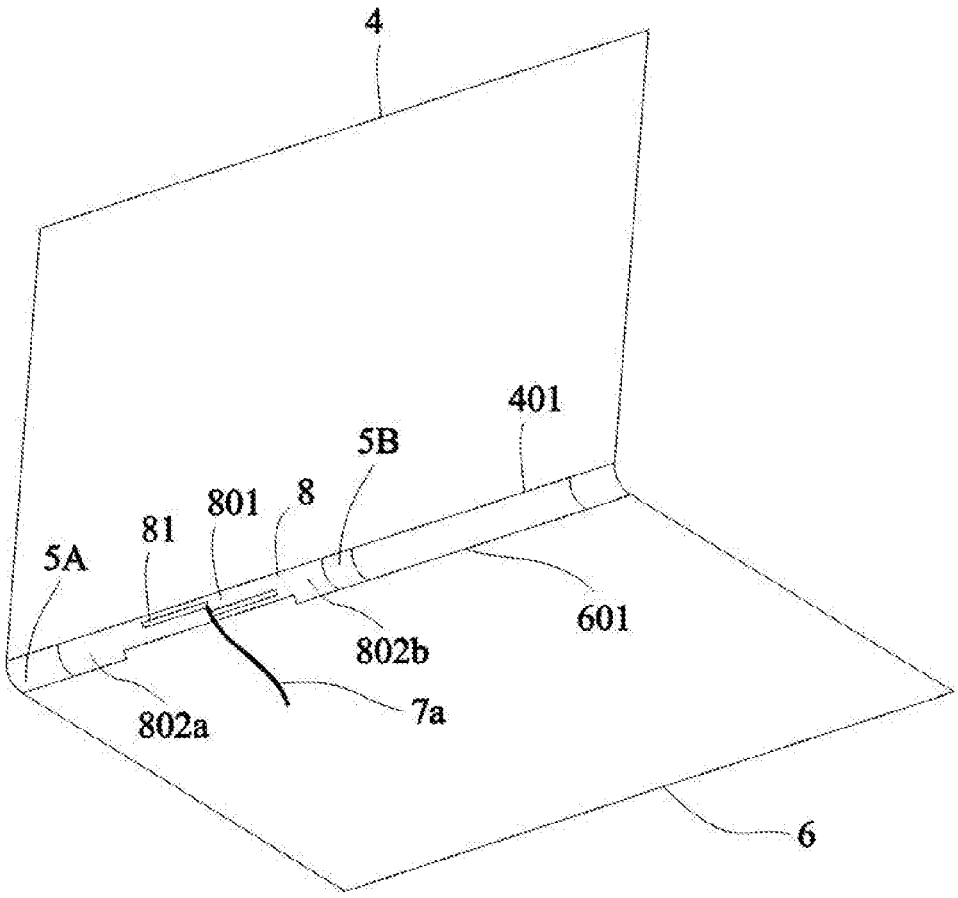
FIG. 2 is a schematic of the front side of a laptop in one embodiment of the disclosure.

The electronic device in the embodiments of the disclosure is a laptop for example. However, the disclosure does not intend to limit the type of the electronic device to the laptop. The electronic device with two metal casings and a hinge connecting them is suitable for the antenna design of the embodiment of the disclosure. The multi-band antenna is implemented by the hinge of the casing of the laptop in the embodiments of the disclosure. The antenna is applicable in, for example, WWAN, LTE, and WLAN or Wi-Fi. Please refer to FIG. 2, which is a schematic of the front side of a laptop in one embodiment of the disclosure. The top cover and the bottom cover of the laptop are respectively the first metal casing and the second metal casing so that the laptop has the metal casing. In FIG. 2, the arrangement of the keyboard, the screen, etc. is omitted so as to emphasize the main elements in the embodiment. As to the main structure of the laptop, the laptop includes a first metal casing 4 (top cover) having a screen, a first hinge 5A, a second hinge 5B, and a second metal casing 6 (bottom cover). The first hinge 5A and the second hinge 5B in the drawing are simply illustrated with lines, but the shape of each the hinges is not limited by the disclosure. The first hinge 5A and the second hinge 5B are used for connecting the first metal casing 4 and the second metal casing 6 so that the first metal casing 4 and the second metal casing 6 may rotate in opposition to each other. In the embodiment, the first hinge 5A and the second hinge 5B are also made of metal so that a slot is composed of the first metal casing 4, the second metal casing 6, the first hinge 5A, and the second hinge 5B, and the slot is taken as a first slot antenna structure 8. In the disclosure, however, the first hinge 5A and the second hinge 5B are not necessarily made of metal. It's only needed that the first hinge 5A and second hinge 5B have good conductivity.

Figure 3:
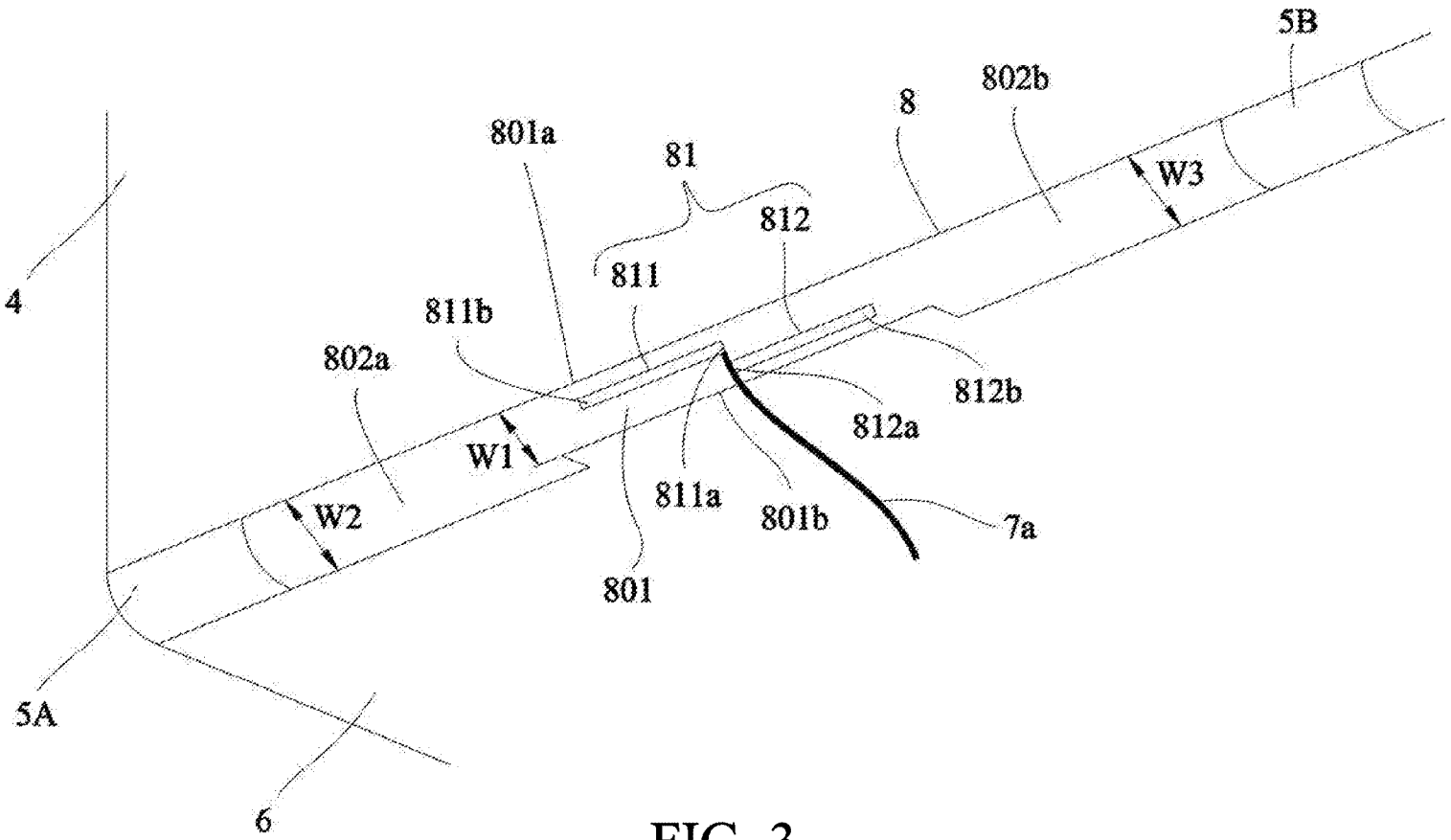
FIG. 3 is a schematic of the first slot antenna structure and a first dipole antenna of the electronic device having the antenna in one embodiment of the disclosure.

The connection between the first metal casing 4 (top cover), the first hinge 5A, the second hinge 5B and the second metal casing 6 (bottom cover) is illustrated hereafter. The first metal casing 4 has a first side edge 41. The second metal casing 6 has a second side edge 61. The first hinge 5A is between the first side edge of the first metal casing and the second side edge of the second metal casing, and is respectively conductively connected to the first side edge 41 of the first metal casing 4 and the second side edge 61 of the second metal casing 6. The second hinge 5B is between the first side edge of the first metal casing and the second side edge of the second metal casing, and is respectively conductively connected to the first side edge 41 of the first metal casing 4 and the second side edge 61 of the second metal casing 6. Hence, the first slot antenna structure 8 is constructed. The first slot antenna structure 8 has a first middle portion 801 and two first end portions 802*a* and 802*b*. Then, please refer to FIG. 2 and FIG. 3 together, wherein FIG. 3 is a schematic of the first slot antenna structure and a first dipole antenna of the electronic device having the antenna in one embodiment of the disclosure. The width W1 of the first middle portion 801 is less than each of the width W2 of the first end portion 802*a* and the width W3 of the first end portion 802*b*, as shown in FIG. 3. The first hinge 5A, the first metal casing 4 and the second metal casing 6 together define the edge of the first end portion 802*a*. Similarly, the second hinge 5B, the first metal casing 4 and the second metal casing 6 together define the edge of the first end portion 802*b*.

Please refer to FIG. 2 and FIG. 3 again. The first dipole antenna 81 has a first radiation portion 811 and a second radiation portion 812. The first radiation portion 811 has a first feeding terminal 811*a*, and the second radiation portion 812 has a first ground terminal 812*a*. The way of feeding signal of the first dipole antenna 81 is, for example, fed with a co-axial cable 7*a*. The first feeding terminal 811*a* is connected to the inner conductor of the co-axial cable 7*a* and the first ground terminal 812*a* is connected to the outer conductor of the co-axial cable 7*a*. In the embodiment, the first radiation portion 811 also has an end 811*b* corresponding to the first feeding terminal 811*a*, and the second radiation portion 812 also has an end 812*b* corresponding to the first ground terminal 812*a*. However, it's not a limitation but only an example. The first dipole antenna 81 is disposed in the first middle portion 801 of the first slot antenna structure 8. Practically, the first dipole antenna 81 is, for example, disposed on a microwave substrate and installed in the first middle portion 801 of the first slot antenna structure 8. However, the disclosure does not intend to limit the way to install the first dipole antenna 81 in the first middle portion 801. The first dipole antenna 81 has a second half-wavelength resonant mode and is used for exciting a first half-wavelength resonant mode of the first slot antenna structure 8. The first metal casing 4, the second metal casing 6, the first hinge 5A and the second hinge 5B are all electrically connected to the first ground terminal 812*a*.

The first dipole antenna 81 couples energy by electromagnetic field to the first slot antenna structure 8 so as to excite the first half-wavelength resonant mode of the first slot antenna structure 8. In the embodiment in FIG. 3, the first middle portion 801 of the first slot antenna structure 8 has a first edge 801*a* and a second edge 801*b*. The first edge 801*a* is on the first side edge 41 of the first metal casing 4 and the second edge 801*b* is on the second side edge 61 of the second metal casing 6. The first radiation portion 811 of the first dipole antenna 81 is adjacent to the first edge 801*a* of the first middle portion 801, and the second radiation portion 812 of the first dipole antenna 81 is adjacent to the second edge 801*b* of the first middle portion 801. In other words, compared to the second radiation portion 812, the first radiation portion 811 is closer to the first edge 801*a*. Compared to the first radiation portion 811, the second radiation portion 812 is closer to the second edge 801*b*. However, the disclosure does not intend to limit the position thereof, the positions of the first radiation portion 811 and the second radiation portion 812 may be exchanged.

Further, in one embodiment of the disclosure, the frequency of the first half-wavelength resonant mode of the first slot antenna structure 8 is less than the second half-wavelength resonant mode of the first dipole antenna 81. The frequency of the second half-wavelength resonant mode of the first dipole antenna 81 is the wireless networking band corresponding to, for example, 2.4 GHz or 5 GHz. The frequency of the first half-wavelength resonant mode of the first slot antenna structure 8 is, for example, the operating frequency corresponding to LTE 700 (698 MHz-787 MHz), GSM 850 (824 MHz-960 MHz), or GSM 900 (880-960 MHz). Alternately, the frequency of the first half-wavelength resonant mode of the first slot antenna structure 8 is, for example, a band corresponding to GSM 1800/1900/UMTS (1710-2170 MHz) or LTE 2300/2500 (2300-2690 MHz). In one embodiment for multi-band application, the second half-wavelength resonant mode of the first dipole antenna 81 is the band of LTE 700, GSM 850, or GSM 900, and a high-order mode of the second half-wavelength resonant mode is the band of GSM 1800/1900/UMTS or LTE 2300/2500. However, the aforementioned bands are for example only, and the operating frequency of either the first slot antenna structure 8 or the first dipole antenna 81 is not limited to the embodiment of the disclosure.

In the embodiment in FIG. 3, the first radiation portion 811 of the first dipole antenna 81 is parallel and adjacent to the first edge 801*a* of the first middle portion 801, and the second radiation portion 812 is parallel and adjacent to the second edge 801*b* of the first middle portion 801. However, the arrangement is not limited to the embodiment of the disclosure. The part of the first radiation portion 811 parallel to the first edge 801*a* may improve the energy coupling so as to excite the second half-wavelength resonant mode. The part of the second radiation portion 811 parallel to the second edge 801*b* may contribute to adjust the impedance matching of the second half-wavelength resonant mode. Furthermore, the width W2 of the first end portion 802*a* and the width W3 of the first end portion 802*b* may be used for adjusting the impedance matching of the first half-wavelength resonant mode of the first slot antenna structure 8 so as to increase the bandwidth.

The disclosure does not intend to limit the shape of each of the first radiation portion 811 and second radiation portion 812. In another embodiment, there are a folding portion between the first feeding terminal 811*a* and the end 811*b* of the first radiation portion 811 of the first dipole antenna 81, and a folding portion between the first ground terminal 812*a* and the end 812*b* of the second radiation portion 812. The shape of the folding portion is, for example, U-shape.

In yet another embodiment, at least part of the first radiation portion 811 of the first dipole antenna 81 is parallel to the first edge 801*a* of the first middle portion 801, and at least part of the first radiation portion 811 of the first dipole antenna 81 is perpendicular to the first edge 801*a* of the first middle portion 801. Hence, compared with the conventional half-wavelength dipole antenna having the mono-polarization radiation field, the first dipole antenna 81 in the embodiment provides the radiation field having more than one polarization direction and benefit for the stability of the communication quality such as the throughput. In the application of wireless network such as the laptop as a wireless terminal device, the antenna having the mono-polarization radiation field may have a blind angle in communication.

Figure 4:
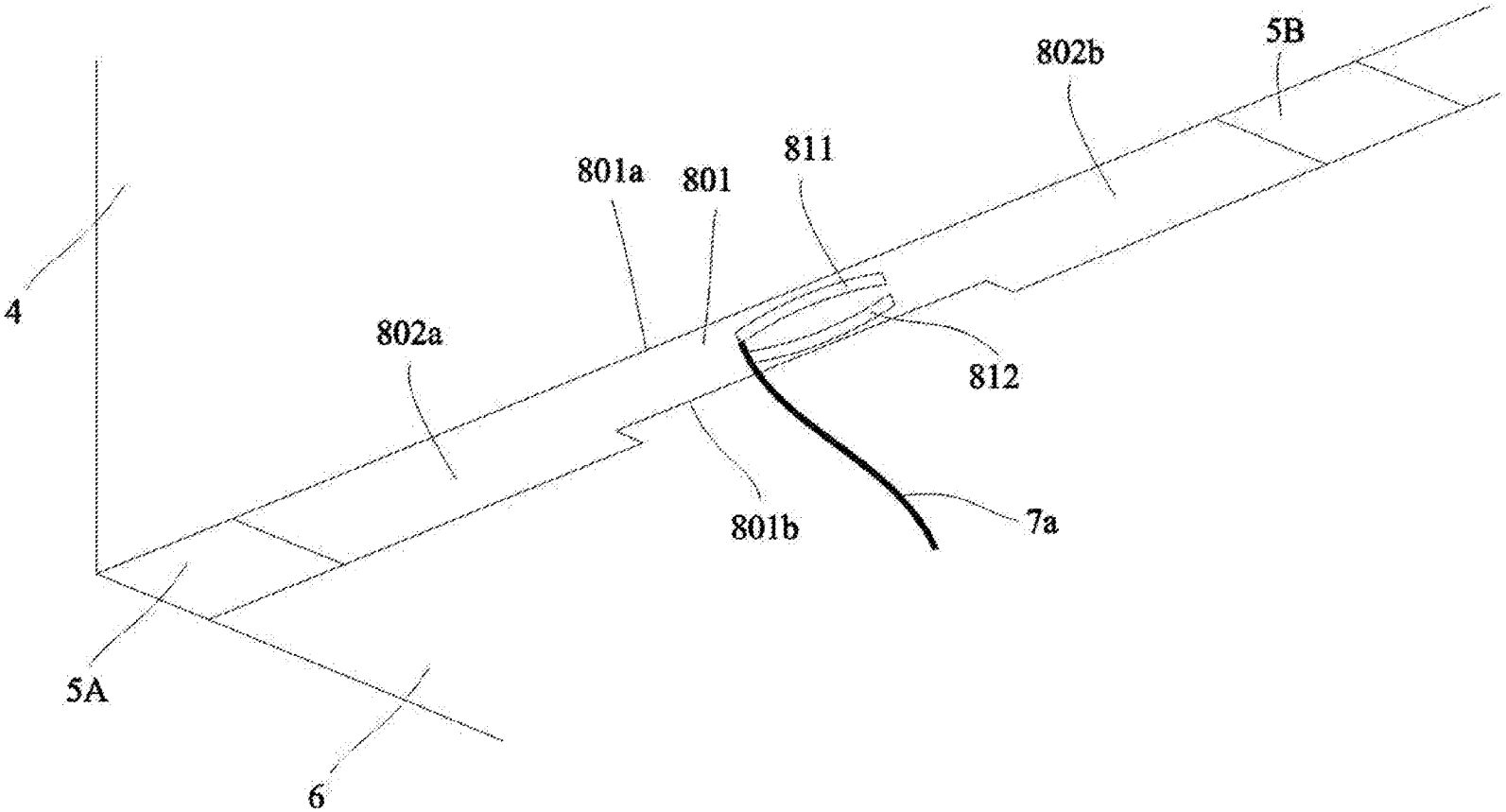
FIG. 4 is a schematic of the first slot antenna structure and a first dipole antenna of the electronic device having the antenna in another embodiment of the disclosure.

In addition, the width W1 of the first middle portion 801 of the first slot antenna structure 8 in the embodiment is less than the width W2 and the width W3 of the first end portions 802*a* and 802*b*. That is, the middle of the slot is narrower than the two ends of the slot, but the disclosure does not intend to limit the shape of the slot. Please refer to FIG. 3 or FIG. 4, the shape of the first middle portion 801 is, for example, an elongate recess. Further, the first end portion 802*a* may be conductively connected to the first hinge 5A, and the first end portion 802*b* may be conductively connected to the second hinge 5B. Hence, the space between the first hinge 5A and the second hinge 5B is used for implementing the first slot antenna structure 8, so the space occupied by the antenna is tremendously reduced. Further, it is applicable for an electronic device having hinge such as the laptop with metal casing.

Figure 5:
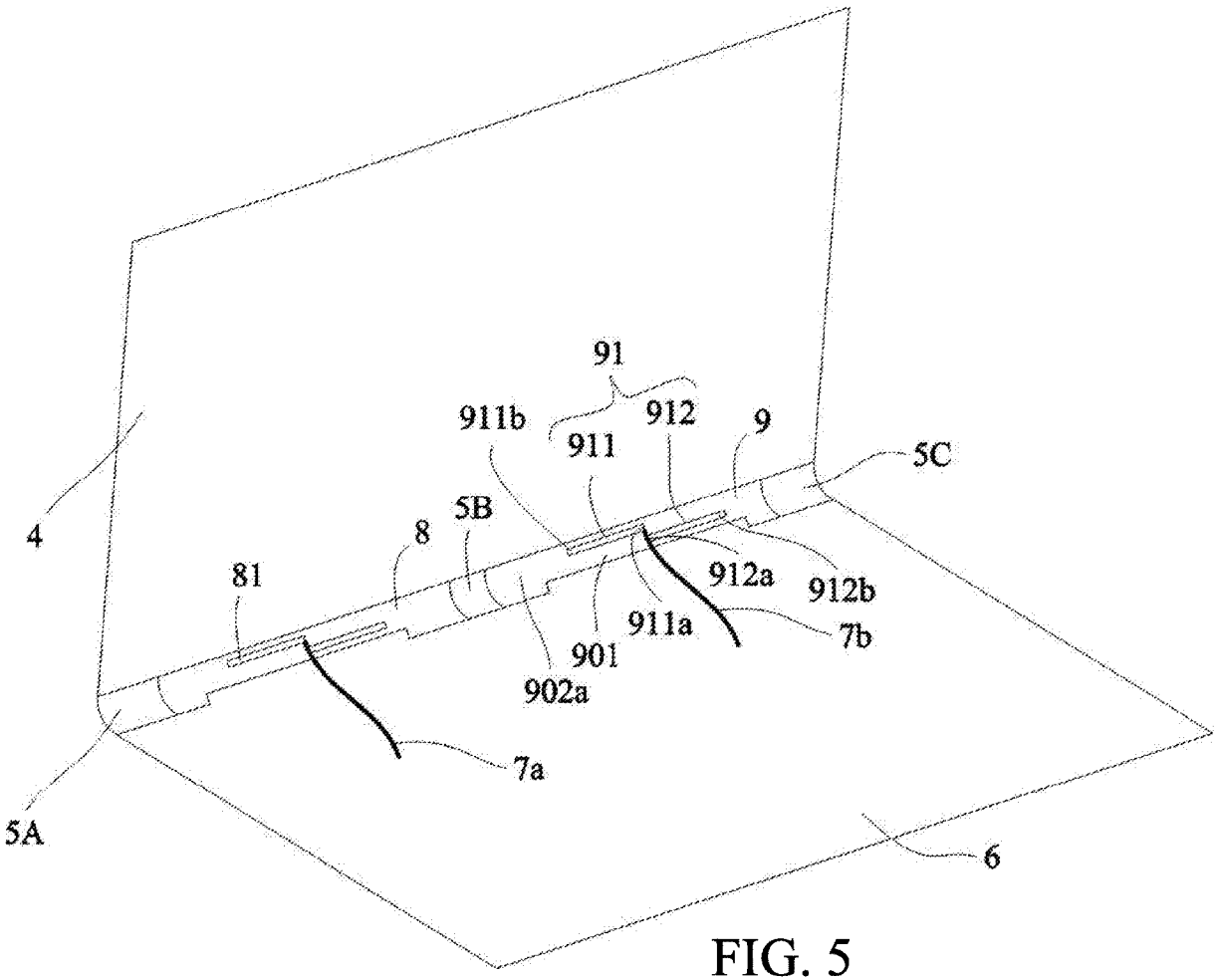
FIG. 5 is a schematic of a laptop having the first slot antenna structure and the second slot antenna structure in one embodiment of the disclosure.

Practically, the size of the laptop for the embodiments of the present disclosure is usually between 11 inch and 15 inch. Hence, if two antennas are needed in the laptop of the embodiments of the present disclosure, please refer to the embodiment in FIG. 5, which is a schematic of a laptop having the first slot antenna structure and the second slot antenna structure in one embodiment of the disclosure. Compared with the embodiment in FIG. 3, there are additionally a third hinge 5C and a second dipole antenna 91 in the embodiment in FIG. 5. The second slot antenna structure 9 and the second dipole antenna 91 therein are similar to the embodiment in FIG. 3. Exemplary, the third hinge 5C is conductively connected to the first side edge 401 of the first metal casing 4 and the second side edge 601 of the second metal casing 6. The second slot antenna structure 9 is composed of the second hinge 5B, the first metal casing 4, the third hinge 5C and the second metal casing 6 and has a third half-wavelength resonant mode. The second slot antenna structure 9 has a second middle portion 901 and two second end portions 902*a* and 902*b*. The width of the second middle portion 901 is less than the width of each of the second end portions 902*a* and 902*b*. The second dipole antenna 91 is disposed in the second middle portion 901 of the second slot antenna structure 9. The second dipole antenna 91 has a fourth half-wavelength resonant mode. The second dipole antenna 91 has a third radiation portion 911 and a fourth radiation portion 912. The third radiation portion 911 has a second feeding terminal 911*a*, and the fourth radiation portion 912 has a second ground terminal 912*a*. The second dipole antenna 91 may be fed in with a co-axial cable 7*b* and used for exciting the third half-wavelength resonant mode of the second slot antenna structure 9. The first metal casing 4, the second metal casing 6 and the third hinge 5C are electrically connected to the second ground terminal 912*a*. Further, the first ground terminal 812*a* of the first dipole antenna 81 and the second ground terminal 912*a* of the second ground terminal 912*a* have a common ground generally.

Further, please refer to the first slot antenna structure 8 in the aforementioned embodiments. The shape of the second middle portion 901 is an elongate recess. The width of each of the two second end portions 902*a* and 902*b* is used for adjusting the impedance matching of the third half-wavelength resonant mode of the second slot antenna structure 9. The second middle portion 901 of the second slot antenna structure 9 has a third edge and a fourth edge. The third edge is on the first side edge 401 of the first metal casing 4, and the fourth edge is on the second side edge 601 of the second metal casing 6. The third radiation portion 911 of the second dipole antenna 91 is adjacent to the third edge of the second middle portion 901, and the fourth radiation portion 912 of the second dipole antenna 91 is adjacent to the fourth edge of the second middle portion 901.

As above, the electronic device having the antenna in the embodiment of the present disclosure has the antenna around the hinge connecting the metal casings of the electronic device. The multi-band operation is achieved with resonant mode of the slot antenna excited by the dipole antenna. Further, the space occupied by the antenna is reduced. Hence, the antenna is integrated with the hinge of the electronic device, especially the electronic device having metal casing. Besides, according to the embodiments of the disclosure, the provided antenna may be applied in WWAN such as LTE 700 (698 MHz-787 MHz), GSM 850(824-960 MHz), GSM 900 (880-960 MHz), GSM 1800/1900/UMTS (1710-2170 MHz), and LTE 2300/2500 (2300-2690 MHz), and applied in 2.4 GHz WLAN and 5 GHz WLAN.

What is claimed is:

1. An electronic device having an antenna, comprising:

a first metal casing having a first side edge;

a second metal casing having a second side edge;

a first hinge conductively connected to the first side edge of the first meta casing and the second side edge of the second metal casing respectively;

a second hinge conductively connected to the first side edge of the first metal casing and the second side edge of the second metal casing respectively, wherein a first slot antenna structure is composed of the first metal casing, the second metal casing, the first hinge and the second hinge, the first slot antenna structure has a first half-wavelength resonant mode, the first slot antenna structure has a first middle portion and two first end portions, and a width of the first middle portion is less than a width of each of the two first end portions;

a first dipole antenna disposed in the first middle portion of the first slot antenna structure, wherein the first dipole antenna has a second half-wavelength resonant mode, the first dipole antenna has a first radiation portion and a second radiation portion, the first radiation portion has a first feeding terminal, the second radiation portion has a first ground terminal, and the first dipole antenna used for exciting the first half-wavelength resonant mode of the first slot antenna structure; wherein both of the first metal casing and the second metal casing are electrically connected to the first ground terminal;

a third hinge electrically connected to the first side edge of the first metal casing and second side edge of the second metal casing, wherein a second slot antenna structure is composed of the second hinge, the first metal casing, the third hinge and the second metal casing, the second slot antenna structure has a third half-wavelength resonant mode, the second slot antenna structure has a second middle portion and two second end portions, and a width of the second middle portion is less than a width of each of the two second end portions; and a second dipole antenna disposed in the second middle portion of the second slot antenna structure, wherein the second dipole antenna has a fourth half wavelength resonant mode, the second dipole antenna has a third radiation portion and a fourth radiation portion, the third radiation portion has a second feeding terminal, the fourth radiation portion has a second around terminal, and the second dipole antenna is used for exciting the third half-wavelength resonant mode of the second slot antenna structure;

wherein, the first metal casing, the second metal casing, and the third hinge are all electrically connected to the second ground terminal.

2. The electronic device having the antenna according to claim 1, wherein the electronic device having the antenna is a laptop.

3. The electronic device having the antenna according to claim 1, wherein both of the first hinge and the second hinge are made of metal, and both of the first hinge and the second hinge are electrically connected to the first ground terminal.

4. The electronic device having the antenna according to claim 1, wherein the first middle portion of the first slot antenna structure has a first edge and a second edge, the first edge is on the first side edge of the first metal casing, the second edge is on the second side edge of the second metal casing, the first radiation portion of the first dipole antenna is adjacent to the first edge of the first middle portion, and the second radiation portion of the first dipole antenna is adjacent to the second edge of the first middle portion.

5. The electronic device having the antenna according to claim 1, wherein a shape of the first middle portion is a elongate recess.

6. The electronic device having the antenna according to claim 1, wherein the width of each of the two first end portions is used for adjusting an impedance matching of the first half-wavelength resonant mode of the first slot antenna structure.

7. The electronic device having the antenna according to claim 1, wherein the second middle portion of the second slot antenna structure has a third edge and a fourth edge, the third edge is on the first side edge of the first metal casing, the fourth edge is on the second side edge of the second metal casing, the third radiation portion of the second dipole antenna is adjacent to the third edge of the second middle portion, and the fourth radiation portion of the second dipole antenna is adjacent to the fourth edge of the second middle portion.

8. The electronic device having the antenna according to claim 1, wherein a shape of the second middle portion is a elongate recess.

9. The electronic device having the antenna according to claim 1, wherein the width of each of the two second end portions is used for adjusting an impedance matching of the third half-wavelength resonant mode of the second slot antenna structure.

* * * * *